United States Patent [19]

von Stein

[11] Patent Number: 4,864,971

[45] Date of Patent: Sep. 12, 1989

[54] CONDENSATE SEPARATOR

[75] Inventor: Günther von Stein, Grafrath, Fed. Rep. of Germany

[73] Assignee: Veit GmbH & Co., Fed. Rep. of Germany

[21] Appl. No.: 179,431

[22] Filed: Apr. 8, 1988

[30] Foreign Application Priority Data

Apr. 23, 1987 [DE] Fed. Rep. of Germany ..... 3713625

[51] Int. Cl.[4] ..... B09B 3/00

[52] U.S. Cl. ..... 122/4 R; 38/77.9; 55/DIG. 3; 122/488

[58] Field of Search ..... 122/488, 489, 490, 4 R; 38/15, 3, 85, 77.9; 55/DIG. 23; 126/369, 369.3

[56] References Cited

U.S. PATENT DOCUMENTS 4,271,791 6/1981 Kime ..... 122/487

4,744,160 5/1988 Elliot et al. ..... 38/15

4,756,103 7/1988 Cartabbia ..... 38/1 B

FOREIGN PATENT DOCUMENTS 122414 2/1972 Denmark ..... 122/488

68073358 11/1968 Fed. Rep. of Germany .

0781493 11/1980 U.S.S.R. ..... 122/488

*Primary Examiner*—Edward G. Favors

*Attorney, Agent, or Firm*—Darby & Darby

[57] ABSTRACT

A condensate separator having a housing formed as a channel profile member with one open side face and including integrally formed mounting portions for fastener elements, the open ends of the channel profile member being closed by respective covers, and the open side face by a carrier carrying the control device.

The condensate separator is particularly suitable for industrial steam-pressing stations.

17 Claims, 5 Drawing Sheets

CONDENSATE SEPARATOR

BACKGROUND OF THE INVENTION

The invention relates to a condensate separator.

Condensate separators for steam consumers, particularly for industrial steam ironing equipment or the like, are used to free the steam supplied for the ironing operation from entrained condensate droplets which might otherwise leave water spots on the fabric, particularly in the case of delicate fabrics. Actually employed condensate separators of the type defined above comprise a housing consisting of two substantially symmetrical shells. These shells are joined to one another to form a capsule housing with the juncture line extending perpendicular in the mounted state. Each of the shells thus comprises the front or rear wall and respective halves of the right and left sidewalls and of the upper and lower end walls. The upper and lower end walls are provided with openings for the steam inlet and outlet to extend therethrough from below and from above, respectively. Both the upper and lower end walls contain one half of the respective openings. The shells of the housing are formed as metal castings. Integrally formed with one of the shells are the boundary walls of a control box to be closed by a cover secured thereto by means of screws and having the essential components of a control circuit mounted thereon. The separator chamber within the housing consists of a straight tube having a greater cross-sectional area than the steam inlet and outlet. Secured to both ends of the separator chamber are reducing couplings for connecting the separator chamber to the steam inlet and outlet. The interior of the houses is completely filled with a heat insulation foam formed in situ.

This known condensate separator is relatively expensive due to its complicated construction and assembly. The operation of joining the several components is time-consuming and thus also expensive. It is moreover not possible to completely protect the control device against the effects of high temperatures, irrespective of the heat insulation. This can result in malfunction or failure of the control circuitry.

It is thus an object of the invention to provide a condensate separator having a simplified and less expensive construction permitting it to be quickly assembled, and which offers improved security with regard to the effects of high temperatures on the control circuitry.

The construction of the condensate separator according to the invention permits a number of housings to be made in one piece together with the required mounting portions for the fastener elements, thus eliminating the necessity of forming individual housing components in a complicated die. It is also no longer required to form the control box integrally with the housing. The described construction also permits the control circuitry to be better protected from the effects of heat radiation and heat conduction. It is finally possible to directly insert the interior components into the housing in a simple manner, so that the assembly operation is considerably facilitated.

A U-shaped cross-sectional configuration of the housing has been found particularly advantageous for the intended purpose.

The housing of the separator according to the invention is advantageously made of an extruded profile.

Such extruded profiles may be cut to any suitable length and are readily available at low cost.

A particularly preferred material for the housing is aluminum.

The specific provision of the mounting portions in the form of continuous ribs as set forth in claim 5 can be accomplished in a particularly simple manner and does not require any finishing operation.

A mounting portion for the sidewall portion is also of particularly simple construction.

An embodiment using identical ribs results in a still further simplified construction.

An embodiment having a cavity communicating through venting slots with the atmosphere permits an improved insulation of the control device against the effects of heat to be achieved.

This insulation is still further improved by a partition preferably made of a thermally insulating material.

Use of a sliding guide with integral ribs, which may be identical, provide for a particularly simple construction for mounting the partition in the housing.

An embodiment is disclosed which is effective with regard to protection against contact and to a further reduction of the effects of heat on the control device.

A cover as having integrally formed connection portions is advantageous for employ with a housing as described in the preceding claims and with housings of any other construction, because this cover greatly simplifies the assembly operation.

A further simplification of the assembly operation is achieved with the necessary diameter transition between the separator chamber and the steam inlet and outlet is provided within the connection portions integrally formed with the respective cover.

This diameter transition may be accomplished in a particularly simple manner, wherein the interior diameter of the socket represents the smaller cross-sectional area, and its outer diameter the greater cross-sectional area.

The cover is made of a steam-resistant plastic material offering still further advantages with regard to manufacturing cost.

BRIEF DESCRIPTION OF THE DRAWINGS

Embodiments of the invention shall now be described in detail by way of example with reference to the accompanying drawings, wherein.

DESCRIPTION OF THE PREFERRED EMBODIMENTS

Figure 1:
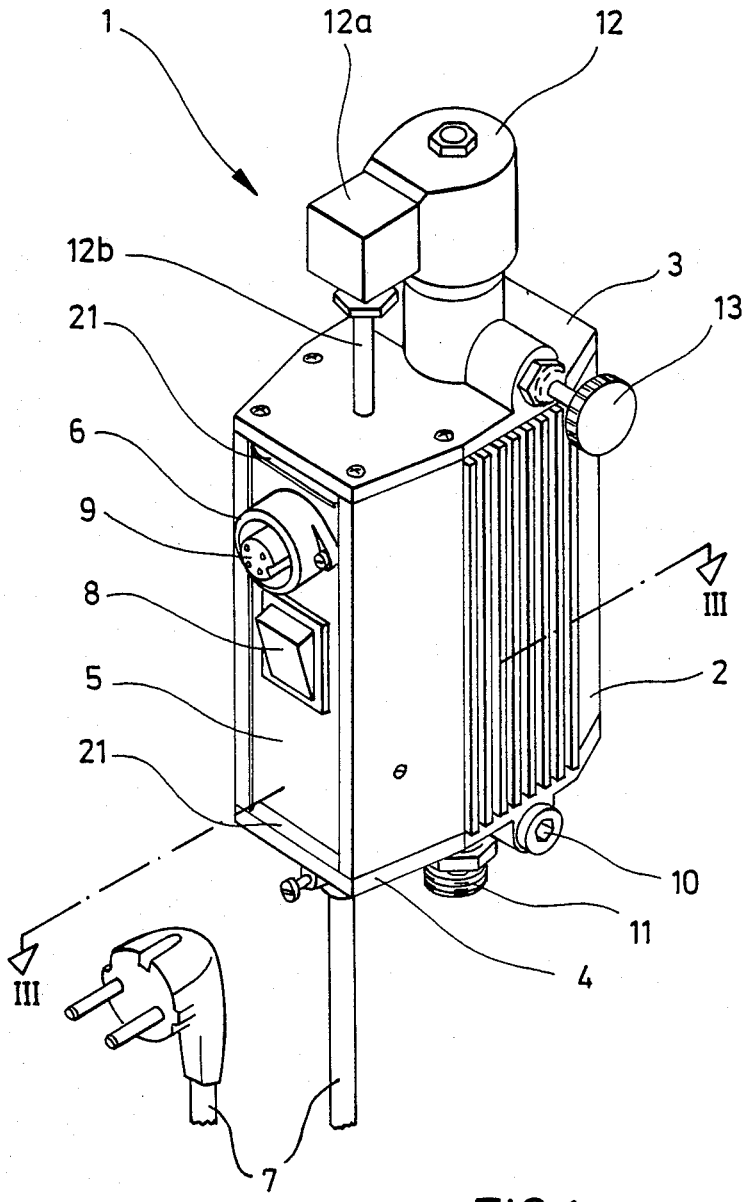
FIG. 1 shows a perspective view of a condensate separator according to a first embodiment of the invention.
Figure 2:
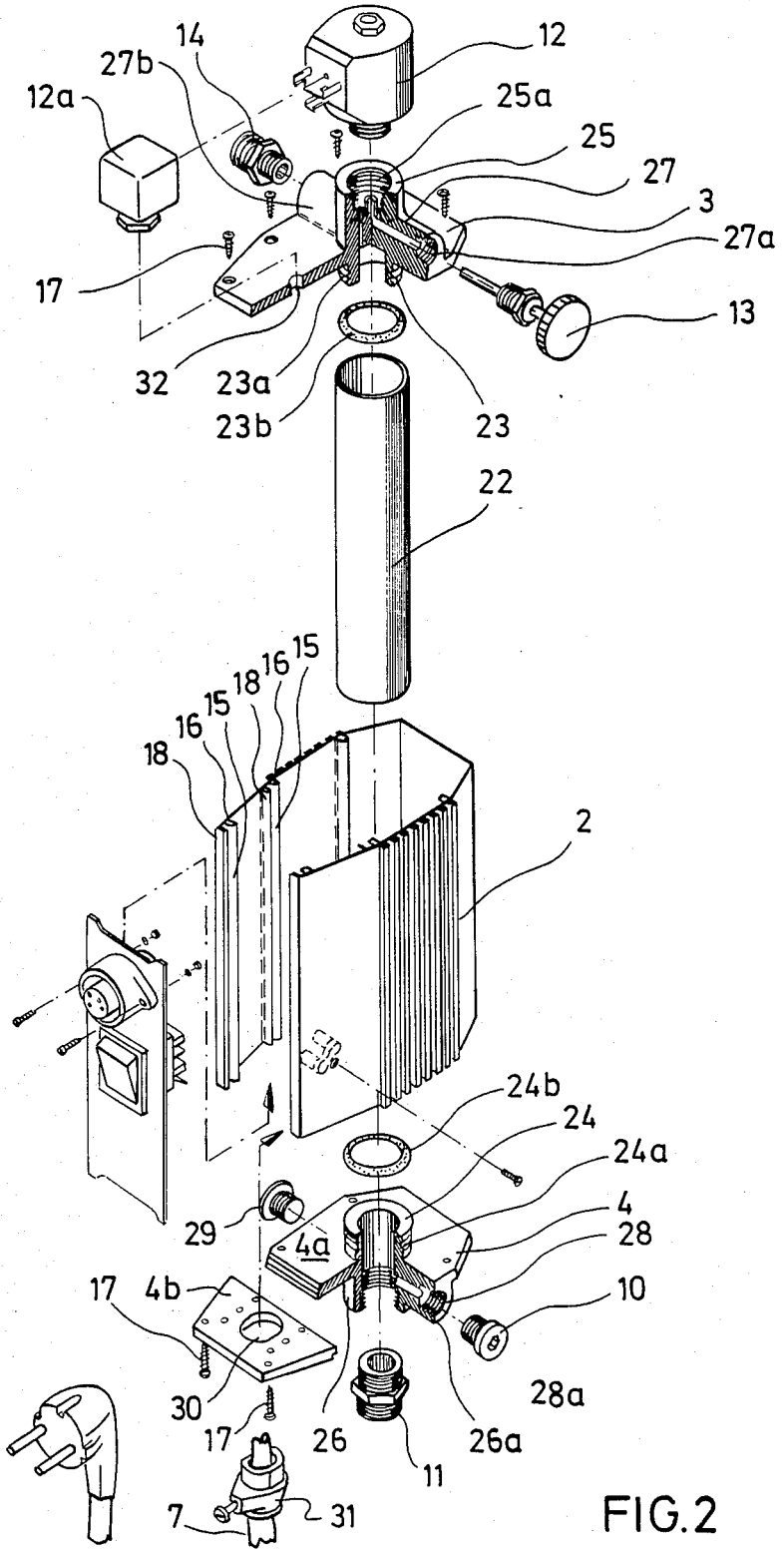
FIG. 2 shows an exploded perspective view of the condensate separator of FIG. 1.
Figure 3:
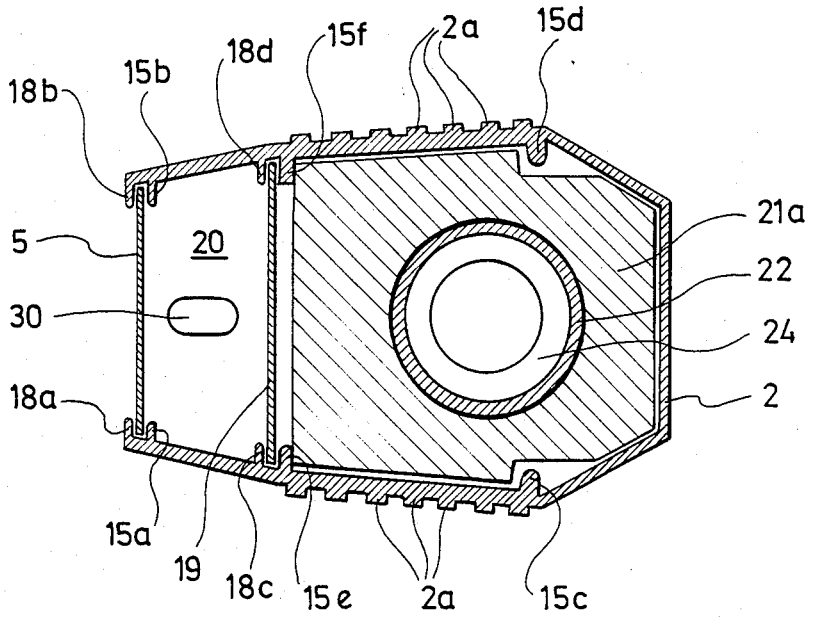
FIG. 3 shows a sectional view taken along III—III in FIG. 1.

FIGS. 1 to 3 show a first embodiment of a condensate separator 1 for use at a steam-pressing station in the clothing industry. Condensate separator 1 has a housing 2 cut to the desired length from a substantially U-shaped extruded channel profile. Outwards projecting portions of the outer wall surface of housing 2 are provided with ribs 2a extending over the full length of housing 2 and serving as a protection against contact and for the dispersion of heat. Housing 2 is installed with its longitudinal axis perpendicular. The open upper and lower ends of housing 2 are closed by respective covers 3 and 4. Mounted in the open sidewall portion of the U-shaped channel profile is a carrier 5 carrying a generally known control unit 6 only partially shown in the drawings. The components associated to control unit 6 and shown in the drawings include an electric power supply cable, a main switch 8, and a socket 9 for the connection of an electric cable of a pressing iron. Lower cover 4 is provided with a connector fitting 10 for a steam supply pipe (not shown) and a connector fitting 11 for a condensate drain pipe (not shown). Upper cover 3 carries a solenoid valve 12 including an actuator 12*a* connected to control unit 6 via a control cable 12*b*, and a manually operable steam flow regulating valve 13. Also provided on upper cover 3 is a connector fitting 14 (FIG. 2) for a steam outlet pipe (not shown).

As shown more clearly in FIGS. 2 and 3, housing 2 is formed with six ribs 15 extending over the full height of housing 2 and projecting towards the interior of housing 2. Two ribs 15*a* and 15*b* are disposed on opposite sides adjacent the open side of the U-shaped channel profile, another two ribs 15*c* and 15*d* are disposed adjacent the bottom wall of the U-shaped channel profile, and still another two ribs 15*e* and 15*f* are disposed intermediate between ribs 15*a* and 15*c* and ribs 15*b* and 15*d*, respectively. As shown in FIG. 2, the end faces of all ribs 15 adjacent the free upper and lower ends of the channel profile are provided with threaded bores 16 adapted to receive respective fastener screws 17 extending through covers 3 and 4 for securing them to housing 2. Covers 3 and 4 may also be secured by means of thread-cutting screws according to DIN 7516 which are directly threaded into the ribs.

Immediately adjacent the open sidewall portion a further pair of continuous ribs 18*a*, 18*b* is formed at spaced locations from the first ribs 15*a* and 15*b*, respectively, to cooperate with the latter in forming a sliding guide for carrier 5. A still further pair of ribs 18*c*, 18*d* is formed at a suitable distance from intermediate ribs 15*e* and 15*f*, respectively, to cooperate with the latter in forming a sliding guide for a partition 19 which may be of a thermally insulating material. Between partition 19 and carrier 5 there remains a cavity 20 for improving the thermal insulation. Cavity 20 communicates with atmosphere through venting slots 21 provided at the upper and lower ends of carrier 5. This results in an air circulation through the cavity for actively cooling the components of the control unit 6. Cavity 20 may also be filled with a thermally insulating material, however, if so desired.

Disposed in housing 2 at the side of partition 19 facing away from cavity 20 is an insulating body 21*a* (FIG. 3) which may for instance be cut to the required length from a suitably shaped extrusion or be assembled from a number of extrusion sections. Insulating body 21 surrounds a separator chamber 22 formed by a tube having a constant diameter. Steam flowing through separator chamber 22 from the bottom to the top is permitted to slightly expand, so that any entrained condensate is precipitated therefrom.

As particularly shown in FIG. 2, covers 3 and 4 are formed as plastic members offering substantially the same connection possibilities. Both covers 3 and 4 may therefore be injection-molded or cast in one and the same die, and can then be mounted in mirror-image orientation. Both covers 3 and 4 are provided with respective tubular sockets 23 and 24, respectively, adapted to project into housing 2 in the mounted state of the covers. The outer diameter of sockets 23 and 24 substantially corresponds to the inner diameter of separator chamber tube 22. The inner diameter of sockets 23 and 24 is considerably smaller by comparison. The outer surface of each socket 23, 24 is formed with a respective groove 23*a*, 24*a* for receiving an O-ring seal 23*b*, 24*b* therein. Tubular separator chamber 22 is mounted on sockets 23 and 24 in such a manner that O-ring seals 23*b*, 24*b* act to hermetically seal chamber 22 from the exterior. Projecting from covers 3 and 4 opposite to the respective sockets 23 and 24 are respective flanges 25 and 26, Cast into each flange 25, 26 is a respective threaded sleeve 25*a*, 26*a*. Solenoid valve 12 is threaded into threaded sleeve 25*a* of cover 3. Threaded sleeve 26*a* of cover 4 serves for securing fitting 11 for the condensate drain oipe. Within both covers 3 and 4 the respective flanges 25, 26 are in communication with the associated sockets 23 and 24, respectively. In the case of cover 3 this flow connection is restricted by integrally formed or inserted reducer fittings to a cross-section ensuring proper functioning of solenoid valve 12 and manually operable regulating valve 13. In cover 4, communication between socket 24 and flange 26 is established by a through-bore of substantially constant diameter. Extending transversely of each flange 25 and 26 is a mounting connector 27, 28, respectively. Each mounting connector 27, 28 has a restricted bore passing therethrough in communication with the interior of the respective flange 25, 26. A first part 27*a* of mounting connector 27 on cover 3 is formed with a threaded bore for receiving screw-threaded regulating valve 13 therein. The part 27*b* of mounting connector 27 coaxially opposite part 27*a* is likewise formed with a threaded bore for receiving steam outlet pipe fitting 14 therein. A first part 28*a* of mounting connector 28 on cover 24 is formed with a threaded bore for receiving steam inlet pipe fitting 10 therein. The other part 28*b* of mounting connector 28 coaxially opposite part 28*a* is likewise formed with a threaded bore which is closed by a threaded plug 29. For facilitating the assembly operation, cover 4 consists of two parts 4*a* and 4*b* to be mounted in overlapping abutment. Cover part 4*a* includes socket 24, flange 26 and mounting connector 28. Cover part 4*b* substantially forms the lower closure of cavity 20 and includes an opening 30 adapted to have a retainer 31 for electric cable 7 non-rotatably mounted therein. A further opening 32 is formed in cover 3 for control cable 12*b* of solenoid valve 12 to pass therethrough.

In operation of condensate separator 1, steam passes through fitting 10 into part 28*a* of mounting connector 28 and from there into flange 26. The diameter increase within flange 26 causes a slight expansion of the steam, which is then directed through socket 24 into separator chamber 22, in which a further slight expansion takes place. The upward flow and expansion of the steal cause any entrained condensate droplets to be precipitated. The thus obtained condensate passes through fitting 11 and is drained via the condensate drain pipe. The remaining steam flows through socket 23, part 27*b* of mounting connector 27, fitting 14 and steam outlet pipe towards a consumer, in particular a steam pressing station. The amount of steam supplied to the consumer and the time of supply are controlled by means of regulating valve 13 and solenoid valve 12, respectively, the latter being itself controlled via a control cable connected between the steam pressing station and socket 9.

Figure 5:
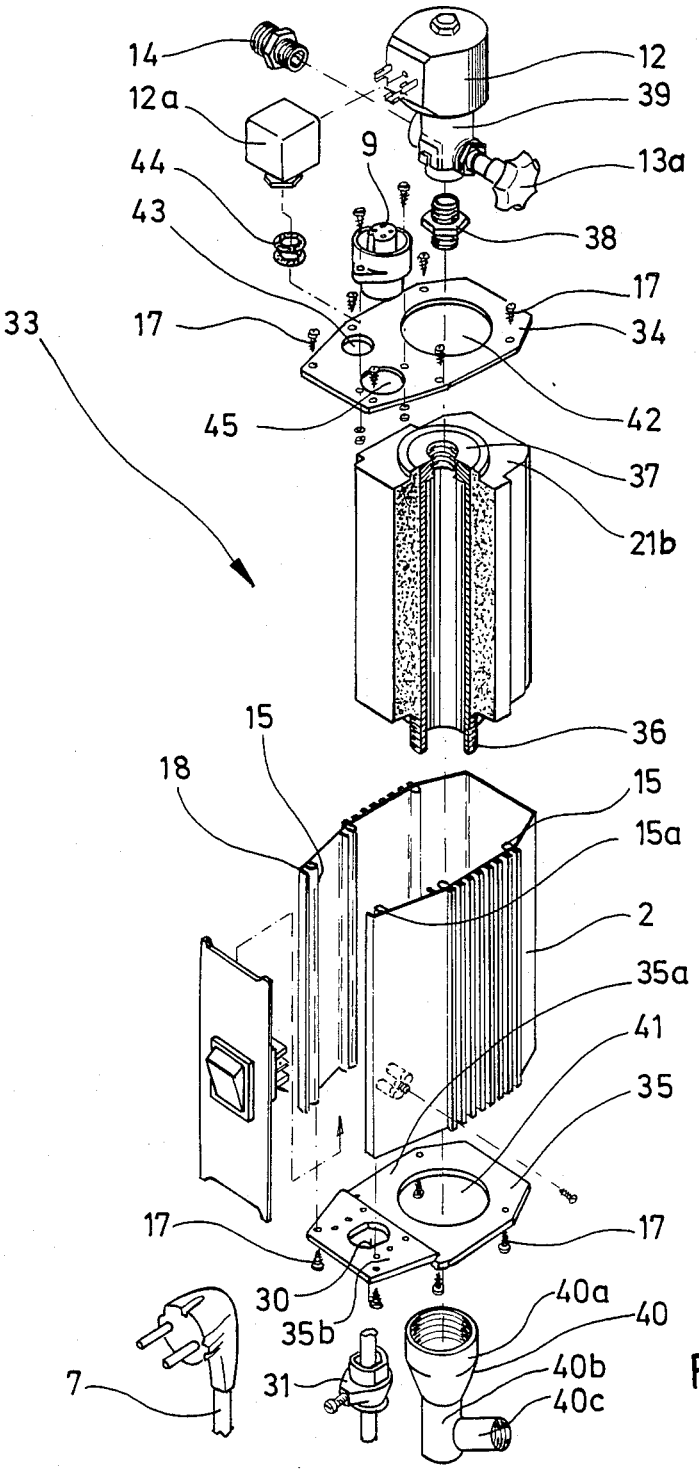
FIG. 5 shows an exploded perspective view of the condensate separator of FIG. 4.

FIGS. 5 and 6 show another embodiment of a condensate separator 33. With the exception of a few details to be described, this condensate separator 33 is substantially of the same construction as separator 1 described above, identical or similar components being therefore designated by the same reference numerals.

Condensate separator 33 likewise has a housing 2 formed of a cut-off length of a U-shaped aluminum channel extrusion and provided with integrally formed heat dispersion ribs 2*a*. Mounted in the open side of housing 2 is carrier 5 with venting slots 21 and main switch 8 by means of the same sliding guide as in condensate separator 1 (FIG. 5). Also provided, although mounted in a different manner to be described, is a solenoid valve 12 with its control unit 12*a* and control cable 12*b*, and a manually operable regulating valve 13*a*. The connection socket 9 for connection to the steam pressing station is disposed on top of condensate separator 33.

As evident from FIG. 5, the main difference between condensate separators 1 and 33 lies in the construction of the covers and the separator chamber. Condensate separator 33 has an upper cover 34 and a likewise divided lower cover 35. Covers 34 and 35 are suitably stamped from a sheet metal. In contrast to covers 3 and 4, covers 34 and 35 do not contribute to the retention of the separator chamber, but merely serve for closing the housing at its upper and lower ends. The separator chamber is again formed as a tube 36, although in this case with an upper end wall 37. End wall 37 is thus disposed at the outlet end of tube 36 and rigidly secured thereto or preferably of integral construction therewith. The thickness of end wall 37 is sufficient for the formation therein of a threaded bore for mounting a connector fitting 38. Connector fitting 38 carries a connector 39 carrying solenoid valve 12, regulating valve 13 and steam outlet pipe fitting 14.

The lower end of pipe 36 projects from insulating body 21*b* and is provided with outer screw threads for threaded engagement with interior threads formed in one leg 40*a* of a T-fitting 40. The coaxially opposite leg 40*b* and the transverse leg 40*c* of T-fitting 40 are likewise provided with interior screw-threads. These two legs 40*b* and 40*c* are adapted to have a condensate drain pipe (not shown) and a steam supply pipe (likewise not shown), respectively, connected thereto. The interior diameters of legs 40*b* and 40*c* are smaller than the interior diameter of tubular condensate separator chamber 36. The transition from the interior diameter of legs 40*b* and 40*c*, respectively, and the interior diameter of separator chamber 36 is formed within leg 40*a*, which comprises a conical portion to this purpose. A part 35*a* of cover 35 has an opening 41 the diameter of which substantially corresponds to the outer diameter of leg 40*a*. The second part 35*b* of cover 35 closes the lower end of cavity 20 and is provided with an opening 30 for non-rotatably mounting clamp 31 for electric cable 7 as already described. The abutting edges of cover parts 35*a* and 35*b* are again in overlapping engagement.

Upper cover 34 is likewise formed with an opening 42 for accommodating connector 39. Another opening 43 in cover 34 contains a bushing 44 for control cable 12*b* to pass therethrough. A further opening 45 is provided for the insertion of connector socket 9.

In operation of condensate separator 33, steam enters leg 40*c* of T-fitting 40 and flows upwards in leg 40*a*. The expansion of the steam begins at this point and continues in tube 36. Precipitated condensate flows downwards through leg 40*b*. The steam then flows through connector fitting 38 into connector 39, and from there through outlet pipe fitting 14 towards the steam pressing station, in an amount determined by regulating valve 13, and under the control of solenoid valve 12.

Figure 4:
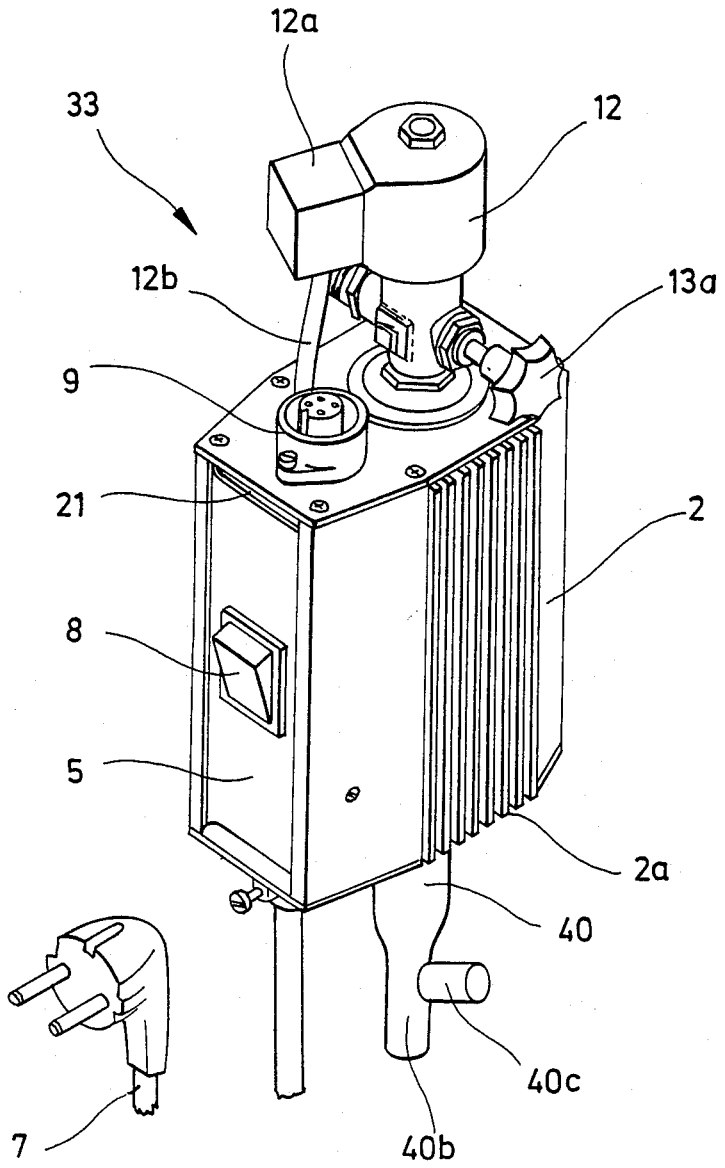
FIG. 4 shows a perspective view of a condensate separator according to another embodiment of the invention.

The above described embodiments of the invention may be varied for instance by interchanging the details depicted in the different figures. In the embodiment of FIG. 1 it is thus for instance possible to mount connector socket 9 on cover 3. The embodiment shown in FIGS. 4 and 5 may also be provided with partition 19. It is also possible to employ cover 35 including T-fitting 40 of condensate separator 33 for condensate separator 1, in which case tube 22 would have to be provided with exterior screw threads. Inversely, condensate separator 33 may be provided with cover 4.

In a particularly suitable modification of the invention, the upper and lower covers are wach of integral construction, This permits particularly covers 3 and 4 to be formed using one and the same die and to be mounted at mirror-image orientation with suitable adaptor bushings mounted in openings 30 and/or 32. The housing may also have a different cross-sectional shape, for instance a circular or oval cross-section with a longitudinal slot, a hexagonal, octogonal or polygonal cross-section with one open side, and the like. The housing may also be die-cast or formed by bending of a planar material. It may also be made of other materials, for instance of a plastic material, another metal, or a metal alloy. The mounting portions for the fastener elements of the covers may be formed as webs, lugs or the like.

The covers with integrally formed connections are particularly advantageous for use with the channel-section housing, it is also possible, however, to employ these covers with other housings to thereby likewise facilitate the assembly operation and thus obtain the advantage of economical production.

I claim:

1. A condensate separator for a steam consumer, particularly for industrial ironing equipment, comprising a housing, a separator chamber disposed in said housing and surrounded by a heat insulation, a control device attached to a carrier, and a steam inlet and steam outlet extending through respective portions of said housing, characterized in that said housing (2) is formed as a channel member having two opposite open ends and an open lateral side, that said open ends are closed by a respective cover (3, 4; 34, 35) having said steam inlet and said stem outlet, respectively, extending therethrough, said covers (3, 4; 34, 35) being secured by means of mounting portions (15) formed integrally with said housing (2) for the engagement by fastener elements (17), and in that said carrier (5) for said control device (6) is formed as a sidewall portion and secured to said open lateral side by means of mounting portions (15, 18) integrally formed with said housing (2).

2. A condensate separator according to claim 1, characterized in that said housing is formed as a substantially U-shaped profile member.

3. A condensate separator according to claim 1, characterized in that said housing (2) consists of a cut-off length of an extruded profile.

4. A condensate separator according to claim 1, characterized in that said housing (2) is made of aluminum.

5. A condensate separator according to claim 1, characterized in that said mounting portions for said fastener elements (17) of said covers (3, 4; 34, 35) are formed as ribs (15) extending over the full length of said housing (2) and adapted to have said covers (3, 4; 34, 35) screwed down on their end faces.

6. A condensate separator according claim 1, characterized in that said mounting portion for said carrier (5) is formed as a sliding guide comprising respective pairs of ribs (15*a*, 18*a*; 15*b*, 18*b*; 15*e*, 18*c*; 15*f*, 18*d*) formed integrally at spaced locations.

7. A condensate separator according to claim 5 or 6, characterized in that at least one of said ribs (15*a*, 15*b*, 15*e*, 15*f*) of said sliding guide is identical with a respective one of said ribs (15) for securing said covers.

8. A condensate separator according to claim 1, characterized in that between said carrier (5) and said heat insulation (21) of said separator chamber (22, 36) there is disposed a cavity (21) communicating with atmosphere through venting slots (21).

9. A condensate separator according to claim 8, characterized in that a partition (19) is disposed between said cavity (20) and said heat insulation (21).

10. A condensate separator according to claim 9, characterized in that said partition (19) is received in a sliding guide (15, 18) consisting of respective pairs of ribs (15*e*, 18*c*; 15*f*, 18*d*) formed integrally with said housing (2) at spaced locations.

11. A condensate separator according to claim 5 or 10, characterized in that at least one of said ribs (15*e*, 15*f*) of said sliding guide is identical with one of said ribs (15) for securing said covers.

12. A condensate separator according to claim 1, characterized in that said housing (2) has heat dispersion ribs (2*a*) formed integrally with its outer surface.

13. A condensate separator, according to claim 1, characterized in that at least one of said covers (3, 4) is provided with integrally formed connecting portions (23, 24, 25, 26) for at least one of said steam inlet and said steam outlet.

14. A condensate separator according to claim 13, characterized in that in the case of a separator chamber (22) having a greater diameter than said at least one of said steam inlet and said steam outlet, the diameter transition is located within said connections portions (23, 24, 25, 26).

15. A condensate separator according to claim 13 or 14, characterized in that at least one of said covers (3, 4) is provided with a socket (23, 24) for the connection of said separator chamber (22).

16. A condensate separator according to claim 15, characterized in that said separator chamber (22) is formed as a tube having a constant diameter and adapted to be slipped onto said socket (23, 24).

17. A condensate separator according to claim 13, characterized in that at least one of said covers (3, 4) consists of a steam-resistant plastic material.

* * * * *